US010638248B1

(12) United States Patent
Dodds et al.

(10) Patent No.: US 10,638,248 B1
(45) Date of Patent: Apr. 28, 2020

(54) GENERATING A MODIFIED AUDIO EXPERIENCE FOR AN AUDIO SYSTEM

(71) Applicant: Facebook Technologies, LLC, Menlo Park, CA (US)

(72) Inventors: Peter Harty Dodds, Seattle, WA (US); Tetsuro Oishi, Bothell, WA (US); Philip Robinson, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/261,298

(22) Filed: Jan. 29, 2019

(51) Int. Cl.

| | |
|---|---|
| ***H04S 7/00*** | (2006.01) |
| ***G10K 11/00*** | (2006.01) |
| ***H04R 1/10*** | (2006.01) |
| ***H04R 3/00*** | (2006.01) |
| ***G10K 11/178*** | (2006.01) |

(52) U.S. Cl.
CPC ..... *H04S 7/303* (2013.01); *G10K 11/17823* (2018.01); *G10K 2210/3044* (2013.01)

(58) Field of Classification Search
CPC ... H04S 7/00; H04S 7/30; H04S 7/302; H04S 7/303; H04S 3/00; H04S 3/008; G06F 3/16; G06F 3/165; G06F 3/167; G10K 11/16; G10K 11/18; G10K 11/175; G10K 11/26; G10K 11/34; G10K 11/18723; H04R 1/10; H04R 1/1083; H04R 3/00; H04R 3/003; H04R 3/12
See application file for complete search history.

(56) References Cited

U.S. PATENT DOCUMENTS

| | | | | |
|---|---|---|---|---|
| 2013/0188800 | A1* | 7/2013 | Asao | G10K 11/178 381/71.1 |
| 2014/0270316 | A1* | 9/2014 | Fan | G02C 11/10 381/381 |
| 2015/0117652 | A1* | 4/2015 | Sato | G10L 21/0216 381/56 |
| 2016/0093282 | A1* | 3/2016 | Moshksar | G10K 11/178 381/71.1 |
| 2016/0112817 | A1* | 4/2016 | Fan | H04R 29/004 381/94.7 |
| 2016/0192073 | A1* | 6/2016 | Poornachandran | G10L 25/51 381/26 |
| 2017/0004818 | A1* | 1/2017 | Khatua | H04R 29/005 |

* cited by examiner

*Primary Examiner* — Thang V Tran
(74) *Attorney, Agent, or Firm* — Fenwick & West LLP

(57) ABSTRACT

An audio system is configured to present a modified audio experience that reduces the degradation of a target audio experience presented to a user by the audio system. The audio system includes an acoustic sensor array, a controller, and a playback device array. To generate the modified audio experience, the acoustic sensor array receives the sound waves from one or more non-target audio source(s) causing the degradation, identifies the audio source(s), determines the spatial location of the audio source(s), determines the type of the audio source(s) and generates audio instructions that, when executed by the playback device array, present the modified audio experience to the user. The modified audio experience may perform active noise cancelling, ambient sound masking, and/or neutral sound masking to compensate for the sound waves received from non-target audio sources. The audio system may be part of a headset that can produce an artificial reality environment.

17 Claims, 5 Drawing Sheets

GENERATING A MODIFIED AUDIO EXPERIENCE FOR AN AUDIO SYSTEM

BACKGROUND

The present disclosure generally relates to generating an audio experience, and specifically relates to generating an audio experience that compensates for sound waves generated by obtrusive audio sources.

Conventional audio systems may use headphones to present a target audio experience including a plurality of audio content. Because the conventional systems use headphones, the target audio experience is relatively unaffected by other audio sources in the local area of the audio system. However, audio systems including headphones occlude the ear canal and are undesirable for some artificial reality environments (e.g., augmented reality). Generating a target audio experience over air for a user within a local area, while minimizing the exposure of others in the local area to that audio content is difficult due to a lack of control over far-field radiated sound. Conventional systems are not able to dynamically present audio content that compensates for sound waves that can be perceived by the user as degrading the target audio experience.

SUMMARY

A method for generating a modified audio experience that reduces the degradation of a target audio experience presented to a user by an audio system. The degradation, or impact, may be caused by a user perceiving sound waves generated by non-target audio sources in the local area of the audio system. The method reduces the degradation, or impact, by presenting modified audio content that compensates for the sound waves generated by the non-target audio source. In some embodiments, the modified audio experience is similar to the target audio experience despite the presence of sound waves generated by the non-target audio sources.

The method determines, via an acoustic sensor array of a headset, sounds waves from one or more audio sources in a local area of the headset. A controller of the headset determines array transfer functions (ATFs) associated with the sounds waves, and determines the spatial location and/or type of the audio sources. The controller generates audio instructions that, when executed by a playback device array, present the modified audio experience to the user. The modified audio experience may perform active noise cancelling, ambient sound masking, and/or neutral sound masking to compensate for the sound waves received from non-target audio sources.

The method may be performed by an audio system. For example, an audio system that is part of a headset (e.g., near-eye display, head-mounted display). The audio system includes an acoustic sensor array, a controller, and a playback device array. The audio system may present the modified audio automatically after detecting an audio source or in response to an input from a user.

Figure 1:
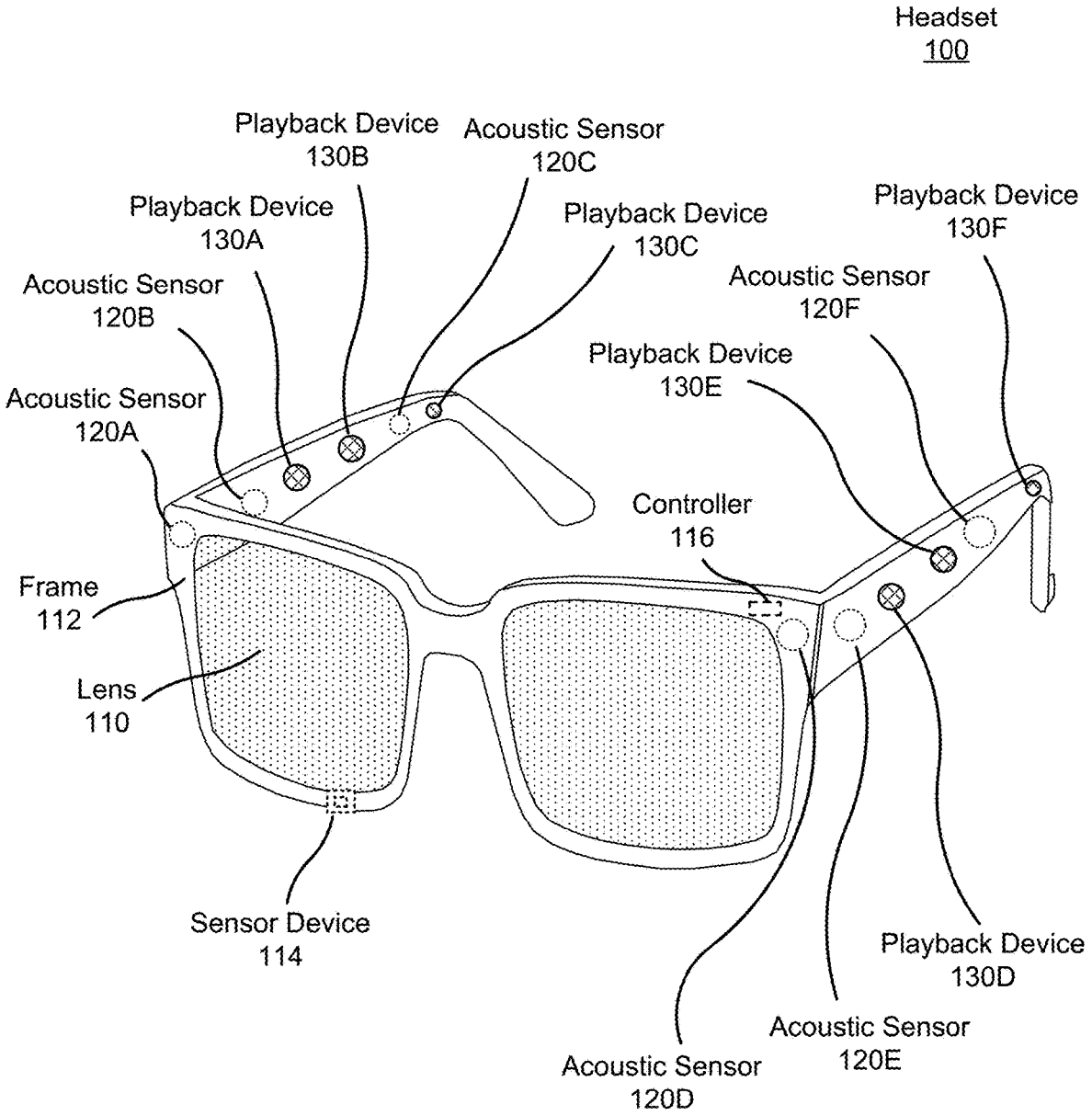
FIG. 1 is a diagram of a headset including an audio system, in accordance with one or more embodiments.

The figures and the following description relate to various embodiments by way of illustration only. It should be noted that from the following discussion, alternative embodiments of the structures and methods disclosed herein will be readily recognized as viable alternatives that may be employed without departing from the principles of what is claimed.

DETAILED DESCRIPTION

Introduction

An audio system generates an audio experience that reduces the perception of an audio source (e.g., distraction) in an auditory field of a user. The audio system may be part of a headset (e.g., near-eye display or a head-mounted display). The audio system includes an acoustic sensor array, a controller, and a playback device array. The acoustic sensor array detects sounds from one or more audio sources in a local area of the headset. The playback device array generates an audio experience for the user by presenting audio content in an auditory field of the user. An auditory field of a user includes the spatial locations from which a user of the headset may perceive audio sources.

The controller generates audio instructions that are executable by the playback device array. The audio instructions, when executed by the playback device array, may present a target audio experience for a user. A target audio experience includes audio content presented to a user that is targeted for the user to perceive in their auditory field during operation of the headset. For example, the audio content elements of a target audio experience presented to a user operating a headset may include a soundtrack to a movie, sound effects in a game, a music playlist, etc.

In some embodiments, the playback device array does not include playback devices that obstruct the ear canal (e.g., earbuds or headphones). This allows a user to perceive sound waves from audio sources in the local area concurrent with audio content presented by the playback device array. Therefore, in some cases, one or more audio sources in a local area may degrade a target audio experience ("non-target audio source") presented to the user by the audio system. Non-target audio sources degrade a target audio experience by generating sound waves that can be perceived as disruptions to and target audio experience presented by the audio system. To illustrate, a non-target audio source may degrade a target audio experience by generating sound waves that interrupt a user's immersion in a target audio experience, provide a distraction in the auditory field of the user, interfere with audio content presented by the audio system, mask audio content presented by the audio system, etc. More generally, a non-target audio source impacts a target audio experience presented to the user in a negative manner.

The controller can generate audio instructions that, when executed by the playback device array, reduce the degradation of the target audio experience ("experience degradation"). To do so, the controller determines transfer functions for the sound waves received from the non-target audio sources, the spatial location(s) of the non-target audio source (s), and the type of non-target audio source(s). The controller then generates audio instructions that, when executed, compensate (i.e., cancel, mask, etc.) for the sound waves degrading the target audio experience. More generally, the controller generates audio instructions that, when executed by the playback device array, reduce the impact of unintended sound waves on the audio experience.

The controller determines transfer functions based on the sound waves received from audio sources. A transfer function is a function that maps sound waves received from multiple acoustic sensors (e.g., an acoustic sensor array) to audio signals that can be analyzed by the controller. The controller may determine the spatial location (e.g., a coordinate) of a non-target audio source based on audio characteristics of the received sound waves and/or the determined transfer functions. The controller may also classify a type of the non-target audio sources based on the audio characteristics of the received sound waves and/or the determined transfer functions. An audio characteristic is any property describing the properties of a sound wave. Some examples of audio characteristics may include, for example, amplitude, direction, frequency, speed, some other sound wave property, or some combination thereof. For example, the controller may classify a non-target audio source as an unobtrusive source (e.g., a fan, a rainstorm, traffic, an air-conditioning unit, etc.) or an obtrusive source (e.g., a person talking, sirens, bird calls, a door slamming, etc.) based on the audio characteristics (e.g., frequency and amplitude) of the sound waves generated by the sources.

The controller generates audio instructions that reduce the experience degradation based on the audio characteristics of the received sound waves, the determined spatial location of a non-target audio source, and/or the determined type of a non-target audio source. In one example, the controller generates the audio instructions by applying head related transfer functions.

The generated audio instructions generated by the controller, when executed by the playback device, present a modified audio experience to the user. The modified audio experience includes the audio content of the target audio experience, but also includes audio content that compensates for the sound waves received from non-target audio sources. In other words, the modified audio experience includes audio content that reduces the experience degradation caused by non-target audio sources. As such, the modified audio experience may be highly similar to the target audio experience despite the presence of sound waves generated by non-target audio source. To illustrate, the modified audio experience may include audio content that performs active noise cancellation, ambient sound masking, and/or neutral sound masking of non-target audio sources. Because of the normalizing audio content, a user may not perceive, or have reduced perception of, the sound waves generated by audio sources in the area.

Various embodiments may include or be implemented in conjunction with an artificial reality system. Artificial reality is a form of reality that has been adjusted in some manner before presentation to a user, which may include, e.g., a virtual reality (VR), an augmented reality (AR), a mixed reality (MR), a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset (e.g., a head-mounted device or near-eye display) connected to a host computer system, a standalone headset, a mobile device or computing system, or any other hardware platform capable of providing artificial reality content to one or more viewers.

Head Wearable Device

FIG. 1 is a diagram of a headset 100 including an audio system, according to one or more embodiments. The headset 100 presents media to a user. In one embodiment, the headset 100 may be a near-eye display (NED). In another embodiment, the headset 100 may be a head-mounted display (HMD). In general, the headset may be worn on the face of a user such that visual content (e.g., visual media) is presented using one or both lens 110 of the headset. However, the headset 100 may also be used such that media content is presented to a user in a different manner. Examples of media content presented by the headset 100 include one or more images, video, audio, or some combination thereof. The media may also include the audio content of an audio experience that may be presented to a user.

The headset 100 includes the audio system, and may include, among other components, a frame 112, a lens 110, a sensor device 114, and a controller 116. While FIG. 1 illustrates the components of the headset 100 in example locations on the headset 100, the components may be located elsewhere on the headset 100, on a peripheral device paired with the headset 100, or some combination thereof. Similarly, any or all of the components may be embedded, or partially embedded, within the headset and not visible to a user.

The headset 100 may correct or enhance the vision of a user, protect the eye of a user, or provide images to a user. The headset 100 may be eyeglasses which correct for defects in a user's eyesight. The headset 100 may be sunglasses which protect a user's eye from the sun. The headset 100 may be safety glasses which protect a user's eye from impact. The headset 100 may be a night vision device or infrared goggles to enhance a user's vision at night. The headset 100 may be a near-eye display that produces artificial reality content for the user. Alternatively, the headset 100 may not include a lens 110 and may be a frame 112 with an audio system that provides audio content (e.g., music, radio, podcasts) to a user.

The lens 110 provides or transmits light to a user wearing the headset 100. The lens 110 may be prescription lens (e.g., single vision, bifocal and trifocal, or progressive) to help correct for defects in a user's eyesight. The prescription lens transmits ambient light to the user wearing the headset 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional detail regarding the lens 110 is discussed with regards to FIG. 5.

In some embodiments, the headset 100 may include a depth camera assembly (DCA) (not shown) that captures data describing depth information for a local area surrounding the headset 100. In some embodiments, the DCA may include a light projector (e.g., structured light and/or flash illumination for time-of-flight), an imaging device, and a controller. The captured data may be images captured by the imaging device of light projected onto the local area by the light projector. In one embodiment, the DCA may include two or more cameras that are oriented to capture portions of the local area in stereo and a controller. The captured data may be images captured by the two or more cameras of the local area in stereo. The controller computes the depth information of the local area using the captured data and depth determination techniques (e.g., structured light, time-of-flight, stereo imaging, etc.). Based on the depth information, the controller determines absolute positional information of the headset 100 within the local area. The DCA may be integrated with the headset 100 or may be positioned within the local area external to the headset 100. In the latter embodiment, the controller of the DCA may transmit the depth information to the controller 116 of the headset 100. In addition, the sensor device 114 generates one or more measurements signals in response to motion of the headset 100. The sensor device 114 may be location on a portion of the frame 112 of the headset 100. Additional detail regarding a depth array camera is discussed with regards to FIG. 5.

The sensor device 114 may include a position sensor, an inertial measurement unit (IMU), or both. Some embodiments of the headset 100 may or may not include the sensor device 114 or may include more than one sensor device 114. In embodiments in which the sensor device 114 includes an IMU, the IMU generates IMU data based on measurement signals from the sensor device 114. Examples of sensor devices 114 include: one or more accelerometers, one or more gyroscopes, one or more magnetometers, another suitable type of sensor that detects motion, a type of sensor used for error correction of the IMU, or some combination thereof. The sensor device 114 may be located external to the IMU, internal to the IMU, or some combination thereof.

Based on the one or more measurement signals, the sensor device 114 estimates a current position of the headset 100 relative to an initial position of the headset 100. The initial position may be the position of the headset 100 when the headset 100 is initialized in a local area. The estimated position may include a location of the headset 100 and/or an orientation of the headset 100 or the user's head wearing the headset 100, or some combination thereof. The orientation may correspond to a position of each ear relative to the reference point. In some embodiments, the sensor device 114 uses the depth information and/or the absolute positional information from a DCA to estimate the current position of the headset 100. The sensor device 114 may include multiple accelerometers to measure translational motion (e.g., forward/back, up/down, left/right) and multiple gyroscopes to measure rotational motion (e.g., pitch, yaw, roll). In some embodiments, an IMU rapidly samples the measurement signals and calculates the estimated position of the headset 100 from the sampled data. For example, the IMU integrates the measurement signals received from the accelerometers over time to estimate a velocity vector and integrates the velocity vector over time to determine an estimated position of a reference point on the headset 100. The reference point is a point that may be used to describe the position of the headset 100. While the reference point may generally be defined as a point in space, however, in practice the reference point is defined as a point within the headset 100.

As previously described, the audio system generates a modified audio experience that reduces the degradation of a target audio experience by compensating for sound waves received by non-target audio sources. In the illustrated example, the audio system comprises an acoustic sensor array, a controller 116, and a playback device array. However, in other embodiments, the audio system may include different and/or additional components. Similarly, in some cases, functionality described with reference to the components of the audio system can be distributed among the components in a different manner than is described here. For example, some or all of the functions of the controller 116 may be performed by a remote server.

The acoustic sensor arrays record sound waves within a local area of the headset 100. A local area is an environment surrounding the headset 100. For example, the local area may be a room that a user wearing the headset 100 is inside, or the user wearing the headset 100 may be outside and the local area is an outside area in which the acoustic sensor array is able to detect sound waves. The acoustic sensor array comprises a plurality of acoustic sensors that are positioned at acoustic detection locations on the headset 100. An acoustic sensor captures sound waves emitted from one or more audio sources in the local area (e.g., a room). Each acoustic sensor is configured to detect sound waves and convert the detected sound waves into an electronic format (analog or digital). The acoustic sensors may be acoustic wave sensors, microphones, sound transducers, or similar sensors that are suitable for detecting sounds. In some embodiments, a port may be included at an acoustic detection location. A port is an aperture in the frame 112 of the headset 100. Each port provides an incoupling point for sound waves from a local area to an acoustic waveguide that guides the sound waves to an acoustic sensor internal to the frame 112 of the headset 10.

In the illustrated configuration, the acoustic sensor array comprises a plurality of acoustic sensors on the headset 100, for example acoustic sensors 120A, 120B, 120C, 120D, 120E, and 120F. The acoustic sensors may be placed on an exterior surface of the headset 100, placed on an interior surface of the headset 100 (and enabled via a port), separate from the headset 100 (e.g., part of some other device), or some combination thereof. In some embodiments, one or more of the acoustic sensors 120A-F may also be placed in an ear canal of each ear.

The configuration of the acoustic sensors of the acoustic sensor array may vary from the configuration described with reference to FIG. 1. The number and/or locations of acoustic sensors may be different from what is shown in FIG. 1. For example, the number of acoustic sensors may be increased to increase the amount of audio information collected and the sensitivity and/or accuracy of the information. The acoustic sensors may be oriented such that the acoustic sensor array is able to detect sound waves in a wide range of directions surrounding the user wearing the headset 100. Detected sound waves may be associated with a frequency, an amplitude, a phase, a time, a duration, or some combination thereof.

The controller 116 determines array transfer functions (ATFs) associated with the sound waves. In some embodiments, the controller 116 may also identify an audio source generating the sound waves based on the ATFs. The controller 116 may determine a spatial location of a determined audio source based on the received sound waves. For example, the controller can determine a coordinate for the non-target audio source relative to the headset 100. Additionally, the controller 116 may determine a type of the determined audio source based on audio characteristics of the received sound waves. For example, the controller can determine that a non-target audio source is an unobtrusive audio source or an obtrusive audio source. The controller generates audio instructions that compensate for sound waves received from identified audio sources based on the audio characteristics of the received sound waves, the determined spatial locations of the non-target audio sources, or the determined type of the non-target audio source. Operations of the controller are described in detail below with regard to FIG. 3.

The playback device array presents audio content using audio instructions generated by the controller 116. The playback device array comprises a plurality of playback devices at acoustic emission locations on the headset 100. Generally, an acoustic emission location is a location of a playback device in the frame 112 of the headset 100. In some examples, an acoustic emission location includes a port. The port provides an outcoupling point of sound from an acoustic waveguide that separates a playback device of the playback device array from the port. Sound emitted from the playback device travels through the acoustic waveguide and is then emitted by the port into the local area.

In the illustrated embodiment, the playback device array includes playback devices 130A, 130B, 130C, 130D, 130E, and 130F. In other embodiments, the playback device array may include a different number of playback devices (more or less) and they may be placed at different locations on the frame 112. For example, the playback device array may include playback devices that cover the ears of the user (e.g., headphones or earbuds). In the illustrated embodiment, the playback devices 130A-130F are placed on an exterior surface (i.e., a surface that does not face the user) of the frame 112. In alternate embodiments some or all of the playback devices may be placed on an interior surface (a surface that faces the user) of the frame 112. Increasing the number of audio playback devices may improve an accuracy (e.g., where audio content is presented) and/or resolution (e.g., size and/or shape of a virtual audio source) of an audio experience presented by the headset 100.

In some embodiments, each playback device is substantially collocated with an acoustic sensor. In other words, each acoustic detection location corresponds to an acoustic emission location. Substantially collocated refers to the acoustic detection location for an acoustic sensor being less than a quarter wavelength away from the corresponding acoustic emission location for a playback device. The number and/or locations of acoustic detection locations and corresponding acoustic emission locations may be different from what is shown in FIG. 1. For example, the number of acoustic detection locations and corresponding acoustic emission locations may be increased to increase control and/or accuracy over a generated sound field.

In the illustrated configuration the audio system is embedded into a NED worn by a user. In alternate embodiments, the audio system may be embedded into a head-mounted display (HMD) worn by a user. Although the description above discusses the audio assemblies as embedded into headsets worn by a user, it would be obvious to a person skilled in the art, that the audio assemblies could be embedded into different headsets which could be worn by users elsewhere or operated by users without being worn.

Example Auditory Environment

Figure 2:
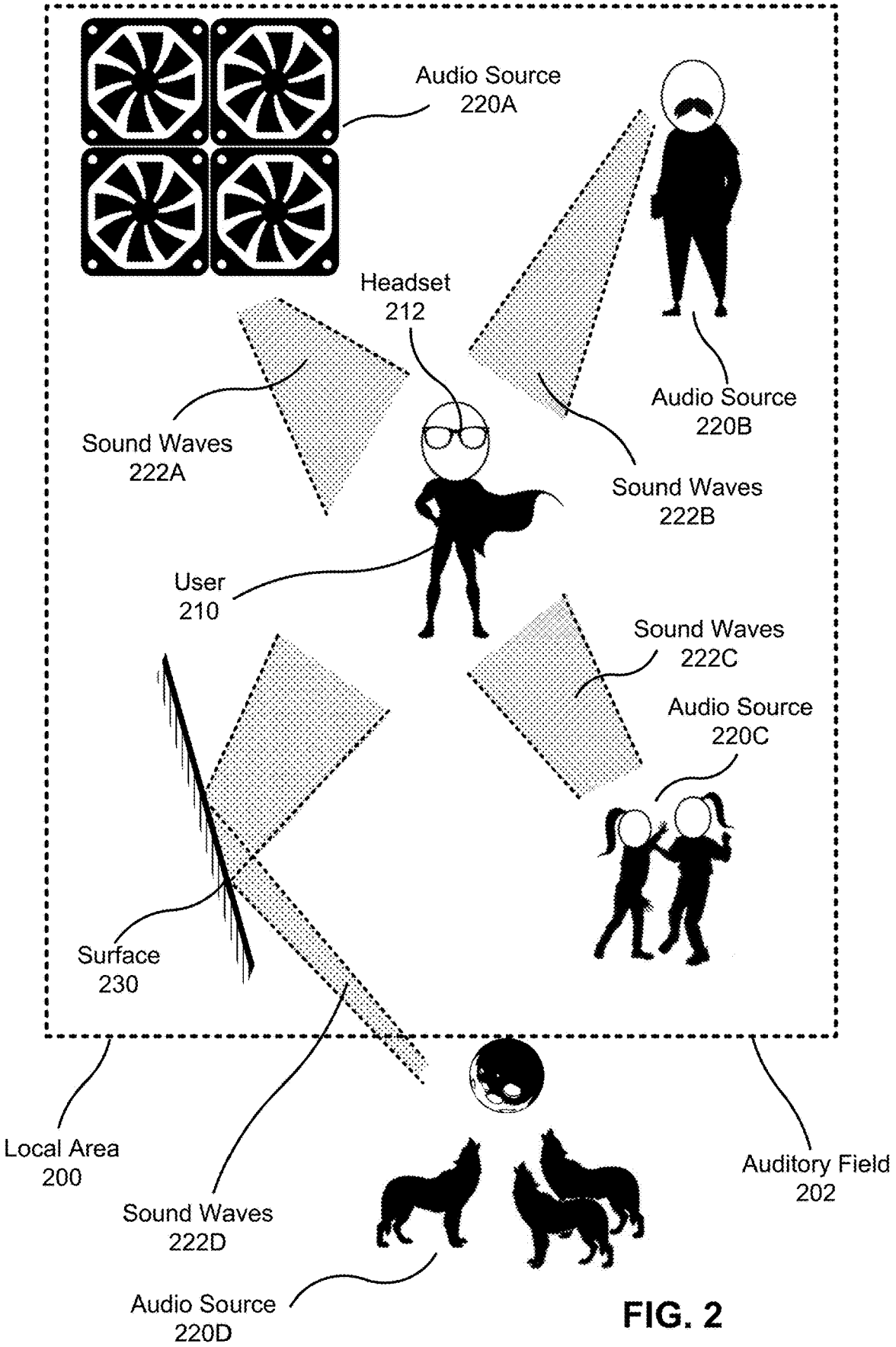
FIG. 2 illustrates a local area of a headset worn by a user perceiving non-target audio sources in their auditory field, in accordance with one or more embodiments.

FIG. 2 illustrates a local area of a headset worn by a user perceiving non-target auditory sources in their auditory field, according to one example embodiment. In one example, the headset 210 is the headset 100 including an audio system described in regards to FIG. 1, but could be other headsets.

The local area 200 is bounded by a dashed line and represents a plurality of spatial locations. In the illustrated example, the local area 200 represents a room in a house, but could be any other local area. The spatial locations within the local area 200 may be defined, for example, as a three-dimensional coordinate (e.g., an x, y, z coordinate) relative to the user 210 and/or the headset 210. The spatial locations may be defined using another coordinate system.

FIG. 2 also illustrates an auditory field 202 of the user 210. The auditory field 202 includes spatial locations in the local area 210 from which the user 210 can perceive sound waves from an audio source. As illustrated, for ease of understanding, the local area 200 and the auditory field 202 are similar, and, therefore, the auditory field 202 includes the spatial locations in the local area 200. In other embodiments, the local area 200 and the auditory field 202 may be dissimilar. For example, an auditory field may be larger than the local area 200 allowing a user to perceive audio sources as if they are outside the local area 200.

The headset 212 presents a target audio experience to the user 210 as the user 210 operates the headset 212. In the illustrated example, the target audio experience includes a plurality of audio content played back by playback devices of the headset 212 as the user 210 plays a superhero themed AR video game. To illustrate, the target audio experience can include the audio content representing punching sounds such as "Pow" in response to the user 210 moving their hand, simulated exclamations of people in the game such as "Look it's a bird," environmental noises such as the explosion of a planet, etc. The headset 212 presents the target audio experience such that the user 210 perceives the audio content at spatial locations within their auditory field 202. For example, the audio content of an exploding plant may be presented to the user 210 within their auditory field 202 such that the exploding planet is perceived as occurring behind the user 210.

In FIG. 2, the local area 200 includes a number of audio sources that are within the user's auditory field 202 (e.g., audio sources 220A, 220B, and 220C). FIG. 2 also illustrates an audio source (e.g., 220D) outside of the local area 200. Each of the audio sources may generate sound waves (e.g., sound waves 222A, 222B, 222C, and 222D) directed toward the user 210. For convenience, herein, the audio sources and sound waves may be referred to in aggregate as audio sources 220 and sound waves 222, respectively. The sound waves 222 are illustrated as a filled area between an audio source 220 and the user 210. In a case where an audio source (e.g., audio source 220D) is outside of the local area 200, the sound waves (e.g., sound waves 222D) generated by the audio source may be redirected towards user 210 by a surface 230 in the local area 200. Because of the reflection, the surface 230 may be considered an intermediate audio source for the sound waves. Each of the audio sources in the local area 200 are located at a spatial location. The spatial locations may be defined in reference to the user 210, the headset 212, or the local area 200.

The sound waves 222 generated by the audio sources 220 may degrade the target audio experience presented by the headset 212. That is, the sound waves 222 may be perceived by the user 210 while operating the headset 212 as audio content that degrades the target audio experience. To illustrate, the user's younger siblings (e.g., audio source 220C) are present in the local area 200 while the user 210 is playing the AR game. The siblings are playing and having a conversation. Some of the sound waves (e.g., sound waves 222C) from the conversation are directed towards the user 210 and the user 210 perceives the sound waves of the conversation in her auditory field 202. In other words, the user hears parts of the siblings' conversation while playing the game. Hearing the conversation degrades the target audio experience presented to the user because the conversation acts as a distraction within her auditory field 202 while she is playing the game.

Other audio sources can also degrade the target audio experience of the user. As illustrated, the audio sources include, for example, a number of fans (i.e., audio source 220A), a speaking person (i.e., audio source 220B), and three wolves howling at the moon (i.e., audio source 220D), but could include many other audio sources at other spatial locations. The audio sources can each generate sound waves that can perceived in different manners by the user. For example, the fans may generate sound waves that are perceived by the user as an ambient background. Many other examples of ambient noise are possible. The speaking person may generate sound waves directed directly towards the user 210 that may be perceived as an interpersonal communication. The wolves may generate sound waves that are perceived by the user 210 as a distracting noise. The headset may determine the type of each of these audio sources and generate a modified audio experience that compensates for the received sound waves.

The headset 212 is configured to determine the spatial location of each of the audio sources 220. In one configuration, acoustic sensors of the headset 212 can receive sound waves 222 and determine the position of the audio source generating the sound waves based on when the acoustic receive the sound waves. For example, the sound waves of the siblings' conversation is received by a first acoustic sensor and a second acoustic sensor of the headset 212 at different times. The headset 212 determines the spatial location of the siblings within the local area using the time differential in the received sound waves and the orientation of the headset. Determining spatial locations is described in more detail in regards to FIG. 3.

The headset 212 is configured to determine the type of audio source generating the sound waves. In one configuration, the controller of the headset determines a set of acoustic characteristics in the sound waves from an audio source. Based on the determined acoustic characteristics, the controller can determine the type of soundwaves received by the headset. For example, the controller determines that the patterns of frequency and amplitudes in the sound waves from the siblings' conversation are indicative of a human conversation. In response, the controller classifies the siblings as an obtrusive audio source.

The headset 212 is configured to generate audio instructions that, when played back by the headset 212, reduce the experience degradation caused by the audio sources 220. For example, the headset 212 may generate audio instructions that are played back as a masking noise that reduces the user's perception of the siblings' conversation. The headset 212 presents the masking noise at the determined spatial location of the siblings. Accordingly, the user 210 perceives the masking noise rather than the sibling's conversation while playing the game, thereby reducing the experience degradation. Alternatively or additionally, the headset 212 may generate audio instructions that, when played back, perform active noise cancellation of the sound waves of the siblings' conversation. Thus, the sound waves of the conversation are reduced and the user 210 has a reduced perception of the conversation while playing the game, thereby reducing the experience degradation.

In another example, the user 210 is listening to a rock and roll album using headset 212. The user's father (e.g., audio source 220A) is yelling at a television in the local area 200. The user 210 perceives the yelling (e.g., sound waves 222B) as a distraction in her auditory field 202 that degrades the target audio experience. The headset 212 determines the spatial location of the user's father and determines that the yelling is causing experience degradation. In response, headset 212 generates audio instructions that are played back to mask the yelling and/or active noise cancel the yelling sound waves. Thus, the headset reduces the experience degradation when listening to the album.

In another example, the user 210 is reading a textbook using the headset 212. The target audio experience is a white noise track played back for the user 210. In this example, three wolves are howling at the moon (e.g., audio source 220D) outside the local area 200. However, a surface 230 in the local area 200 reflects the sound waves (e.g., sound waves 222D) towards the user 210. The user perceives the howling wolves as a distraction in her auditory field 202 that degrades the target audio experience. The headset 212 determines the spatial location of the reflecting surface 230 and determines that the howling is causing experience degradation. In response, headset 212 generates audio instructions that are played back to mask the howling and/or active noise cancel the howling sound waves. Thus, the headset 212 reduces the experience degradation when reading the textbook. In a similar example, rather than a white noise track, the target audio experience may be "silence" for the user. In this case, the headset generates audio instruction that are played back to active noise cancel the howling sound waves. In other words, in various embodiments, the headset can perform noise masking and/or active noise cancelling when the target audio experience is silence or quiet.

Additional examples of generating audio content to reduce the experience degradation are described herein.

Audio System

Figure 3:
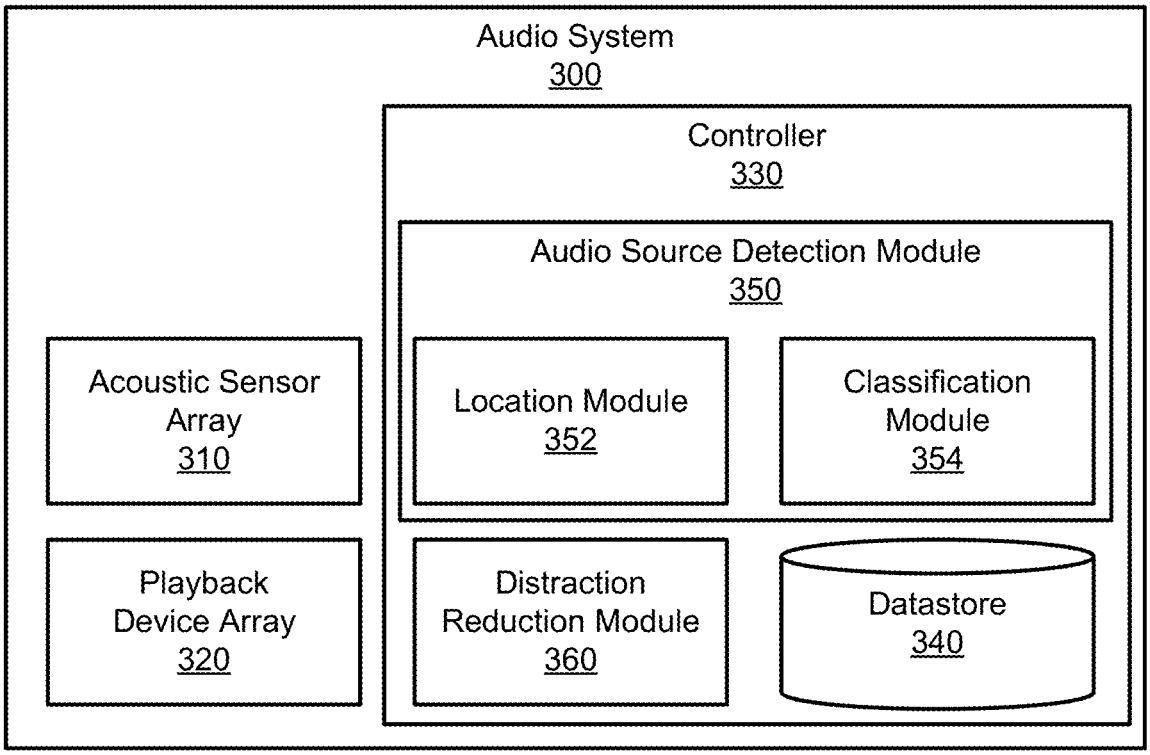
FIG. 3 is a block diagram of an example audio system, according to one or more embodiments.

FIG. 3 is a block diagram of an audio system 300, in accordance with one or more embodiments. The audio system 300 may be a component of a headset providing audio content to the user. The audio system of FIGS. 1 and 2 may be an embodiment of the audio system 300. The audio system 300 includes an acoustic sensor array 310, a playback device array 320, and a controller 330. Some embodiments of the audio system 300 have different components than those described here. Similarly, the functions can be distributed among the components in a different manner than is described here. And in some embodiments, some of the functions of the audio system may be part of different components (e.g., some may be part of a headset and some may be part of a console and/or server).

The acoustic sensor array 310 detects sound waves from one or more audio sources in a local area (e.g., local area 200). The acoustic sensor array 310 is part of a headset (e.g., headset 100 and headset 212). The acoustic sensor array 310 includes a plurality of acoustic sensors. An acoustic sensor is located at an acoustic sensing location and may include a port. The port is an aperture in a frame of the headset. The port provides an incoupling point for sound waves from a local area to an acoustic waveguide that guides the sounds to an acoustic sensor. The plurality of acoustic sensors are located on the headset, and are configured to capture sounds waves emitted from one or more audio sources in the local area. The plurality of acoustic sensors may be positioned on the headset to detect sound sources in all directions relative to the user. In some embodiments, the plurality acoustic sensors may be positioned to provide enhanced coverage in certain directions relative to other directions. Increasing the number of acoustic sensors comprising the acoustic sensor array may improve the accuracy of directional information from the acoustic sensor array to the one or more audio sources in the local area. The acoustic sensors detect air pressure variations caused by a sound wave. Each acoustic sensor is configured to detect sound waves and convert the detected sound waves into an electronic format (analog or digital). The acoustic sensors may be acoustic wave sensors, microphones, sound transducers, or similar sensors that are suitable for detecting sounds.

The playback device array 320 presents an audio experience including audio content. The presented audio content is based in part on the sound waves received from audio sources, determined spatial locations for those sound waves, and/or the determined type of the audio sources. The presented audio content has may compensate for the sound waves received from the audio sources to reduce the degradation of a target audio experience presented by the audio system 300.

The playback device array 320 includes a plurality of playback devices located at acoustic emission locations on the headset. An acoustic emission may also include a port in a frame of the headset. The port provides an outcoupling point of sound from an acoustic waveguide that separates a speaker of the playback device array from the port. Sound emitted from the speaker travels through the acoustic waveguide and is then emitted by the port into the local area.

A playback device may be, e.g., a moving coil transducer, a piezoelectric transducer, some other device that generates an acoustic pressure wave using an electric signal, or some combination thereof. In some embodiments, the playback device array 320 also includes playback devices that cover each ear (e.g., headphones, earbuds, etc.). In other embodiments, the playback device array 320 does not include playback devices that occlude the ears of a user.

Each acoustic sensor may be substantially collocated with a playback device. Here, substantially collocated refers to each acoustic sensor being less than a quarter wavelength away from the corresponding playback device, e.g., wherein the smallest wavelength comes from the highest frequency distinguishable by the audio system 300. The reciprocity theorem states that the free-field Green's function is dependent on the distance between the source/receiver pair and not the order in which that pair is described, thus collocation is optimal according to such an approach. This allows multichannel recordings on the acoustic sensor array 310 to represent an equivalent acoustic playback device array 320 reproduction path back out into the local area. In other embodiments, the acoustic sensor and the corresponding acoustic emission location may not be substantially collocated; however, there may be a compromise in performance with the pair of locations not being substantially collocated or at least within a quarter wavelength.

The controller 330 controls operation of the audio system 300. The controller 330 may include a data store 340, an audio source detection module 350, and a distraction reduction module 360. The audio source detection module may include a location module 352 and a classification module 354. Some embodiments of the controller 330 have different components than those described here. Similarly, the functions can be distributed among the components in a different manner than is described here. And in some embodiments, some of the functions of the controller 330 may be performed by different components (e.g., some may be performed at the headset and some may be performed at a console and/or server).

The data store 340 stores data for use by the audio system 300. Data in the data store 340 may include any combination of audio content, one or more HRTFs, other transfer functions for generating audio content, or other data relevant for use by the audio system 300, etc. Audio content, more particularly, can include a plurality of audio instructions that, when executed by the audio system, present audio content to a user as part of an audio experience.

Audio content stored in the datastore 340, or generated by audio system 300, may specify a target presentation direction and/or target presentation location for the audio content within a user's auditory field. The audio content may be presented by the audio system 300 as an audio source in a target presentation direction and/or at a target presentation location. The audio content is presented such that the user perceives the audio content as an audio source at the target presentation location and/or target presentation direction in their auditory field. Herein, a target presentation location is a spatial location from which audio content presented by the audio system 300 appears to originate from. Similarly, a target presentation direction is a vector (or some other directionality indicator) from which audio content presented by the audio system is perceived to originate from. For example, audio content includes an explosion coming from a target presentation direction and/or location behind the user. The audio system presents the audio content at the target presentation direction and/or location such that the user perceives the explosion at the target presentation direction and/or location behind them.

In some embodiments, a target presentation direction and/or location may be organized in a spherical coordinate system with the user at an origin of the spherical coordinate system. In this system, a target presentation direction is denoted as an elevation angle from a horizon plane and an azimuthal angle in the horizon plane. Similarly, in the spherical coordinate system, a target presentation location includes an elevation angle from the horizon plane, an azimuthal angle on the horizon plane, and a distance from the origin. Other coordinate systems are also possible.

Audio content of an audio experience may be generated according to a set of HRTFs stored in the datastore 340. An HRTF is a function that allows audio content to be presented to a user in a target presentation direction and/or location. The set of HRTFs may include one or more generic HRTFs, one or more customized HRTFs, or some combination thereof. To illustrate, consider an example set of HRTFs that allow audio content to be presented to a user at a target presentation location within their auditory field according to a spherical coordinate system. The audio system 300 determines a system orientation of the audio system (e.g., headset) and a relative orientation between the target presentation direction and/or location and the system orientation. The audio system determines a set of HRTFs that allows audio content to be presented at the appropriate spatial location in a user's auditory field based on the system orientation and relative orientation. The audio system applies the set of HRTFs to generate audio instructions for the audio content. Because of the HRTFs, the audio content will be perceived at an elevation angle, an azimuthal angle, and a radial distance representing the target presentation location in the spherical coordinate system. To illustrate, continuing the example, the audio system presents audio content comprising binaural acoustic signals generated from a set of spherical HRTFs to the ears of the user. Due to the user's hearing perception, the user perceives the audio content as originating from an audio source at the target presentation location with the elevation angle, the azimuthal angle, and the radial distance. Other sets of HRTFs are also possible.

In many cases, a user operating an audio system 300 is not stationary. As such, the system orientation of the audio system 300 may change and, therefore, the relative orientation between the system orientation and target presentation location and/or direction may change. In these situations, the audio system 300 may continuously determine new relative orientations and new system orientations. The audio system 300 may additionally modify (or select) HRTFs that allow the audio content to be presented at the correct target presentation directions and/or locations based on the new system orientation and/or new relative orientations. In this manner, the audio system 300 can continuously present audio content at a target spatial location and/direction as the orientation of the audio system changes.

The audio source detection ("ASD") module 350 detects audio sources (e.g., non-target audio sources) in a local area of the headset. To do so, the ASD module 350 estimates transfer functions using sound waves received at the acoustic sensor array 310 from audio sources in a local area of the headset. The ASD module 350 determines that an audio source is present based on the sound waves captured by the acoustic sensor array 310. In some embodiments, the ASD module 350 identifies audio sources by determining that certain sounds are above a threshold, e.g., an ambient sound level. In other embodiments, the ASD module 350 identifies audio sources with a machine learning algorithm, e.g., a single channel pre-trained machine learning based classifier may be implemented to classify types of audio sources. The ASD module 350 may identify, for example, an audio source as a particular range of frequencies that have amplitude that is larger than a baseline value for the local area.

In some examples, the ASD module 350 determines an audio source after receiving an input from a user. For example, a user may state "That sound is distracting" and the ASD module 350 identifies an audio source in the local area that may be causing the distraction. In some cases, the user may be even more specific. For example, a user may state "That bird is distracting" and the ASD module 350 identifies an audio source generating sound waves representing a bird. Other user inputs are also possible. For example, a user may make a hand gesture, utilize an input device in a particular manner, look in a particular direction, or some other action to indicate to the ASD module 350 to determine an audio source.

For each identified audio source, the ASD module 350 can determine a transfer function for each of the acoustic sensors. A transfer function characterizes an acoustic sensor of receives sound waves from a spatial location in a local area. Specifically, the transfer function defines a relationship between parameters of the sound waves at its source location (i.e., location of the audio source emitting the sound waves) and parameters at which the acoustic sensor detected the sound waves. Parameters associated with the sound waves may include frequency, amplitude, time, phase, duration, a direction of arrival (DoA) estimation, etc. For a given audio source in the local area, a collection of transfer functions for of all of the acoustic sensors in the acoustic sensor array 310 is referred to as an ATF. An ATF characterizes how the acoustic sensor array 310 receives sound waves from the audio source, and defines a relationship between parameters of the sound waves at the spatial location of the audio source and the parameters at which the acoustic sensor array 310 detected the sound waves. In other words, the ATF describes propagation of sound waves from each audio source to each acoustic sensor, and, additionally, propagation of sound waves from each acoustic sensor to some other point in space. Accordingly, if there are a plurality of audio sources, the ASD module 350 determines an ATF for each respective audio source.

A location module 352 determines the spatial location of identified audio sources. In one example, the location module 352 determines a spatial location of an audio source by analyzing the determined ATF associated with an identified audio source and/or sound waves received by the acoustic sensor array 310. For example, the location module 352 can analyze the parameters of an ATF for an identified audio source to determine its spatial location. To illustrate, consider an audio source generating sound waves directed at a user wearing a headset. The sound waves are received at acoustic sensors of the acoustic sensor array 310 included in the audio system 300 of a headset worn by the user. The ASD module 350 identifies the audio source and determines an ATF for the audio source as described herein. The parameters of the ATF indicate that sound waves generated by the audio source arrived at different acoustic sensors of the acoustic sensor array 310 at different times. Further, the parameters indicate that the sound waves received at different acoustic sensors have different frequency responses corresponding to the location of each acoustic sensor on the frame of the headset. The location module 352 determines the spatial location of the identified audio source using the differences in sound wave arrival times and frequency responses. Other methods of determining a spatial location based on determined ATFs and/or received sound waves are also possible. For example, location module 352 can triangulate a location based on a time signal that is received at various acoustic sensors of the acoustic sensor array.

In some embodiments, a classification module 354 determines a background sound level using sounds detected from the local area. The classification module 354 may, e.g., monitor sounds within the local area over a period of time. The classification module 354 may then identify and remove outliers from the monitored sounds (e.g., sounds with amplitudes that differ more than ~10% from an average amplitude level) to determine an adjusted range of monitored sounds. The classification module 354 may then set the background sound level as an average amplitude level of the adjusted range of monitored sounds.

In some embodiments, a classification module 354 determines a background sound level using a predetermined threshold. For example, the classification module 354 may access a sound pressure level (e.g., 45 dB SPL) stored in datastore 340. The classification module 354 may, e.g., monitor sounds within the local area using the acoustic sensor array and determine a sound pressure level for the monitored sounds. If any of the monitored sounds are above the sound pressure level, the audio system 300 may sound mask those sounds. In some embodiments, the sound pressure level may be different for different environments (e.g., an office, outdoors, etc.) or applications (e.g., studying, gaming, etc.).

Additionally, in some embodiments, the classification module may spatially determine a background sound level. That is, the background noise level may be different for spatial regions in a user's auditory field. For example, the background level in front of a user may be a first background level and the background level behind the user may be a second background level.

The classification module 354 determines a type of identified audio sources. The classification module 354 identifies that an audio source is present in sound waves captured by the acoustic sensor array 310. In some embodiments, the classification module 354 identifies sound sources by determining that certain sounds are above a threshold, e.g., the background sound level. In other embodiments, the classification module 354 identifies sound sources with a machine learning algorithm, e.g., a single channel pre-trained machine learning based classifier may be implemented to classify between different types of sources. The classification module 354 may, e.g., identify a sound source as a particular range of frequencies that have amplitude that is larger than the background sound level for the local area.

The classification module 354 can determine the type of an identified audio source as being an obtrusive audio source or an unobtrusive audio source based on the determined ATFs. An unobtrusive audio source is an audio source that generates sound waves that, when perceived by the user, do not degrade a target audio experience. Unobtrusive audio sources may include, for example, a fan, an air-conditioning unit, background noise of an office, or any other unobtrusive audio source. An obtrusive audio source is an audio source that generates sound waves that, when perceived by the user, degrade a target audio experience. Obtrusive audio source may include, for example, a person or persons speaking, a door slamming, music playing, birds chirping, traffic noises, or any other obtrusive audio source. Notably, these examples of unobtrusive and obtrusive audio sources are provided for context. In some situations, unobtrusive audio sources may be obtrusive audio sources and vice versa. What represents an unobtrusive and/or obtrusive audio source may be determined by audio system 300, defined by a user of the audio system, or defined by a designer of the audio system.

The classification module 354 determines the type of the audio source (e.g., obtrusive or unobtrusive) by analyzing the determined ATF for the identified audio source and/or sound waves detected by the acoustic sensor array 310. In some embodiments, the classification module 354 classifies an audio source as obtrusive if it has a sound level greater than a threshold value (e.g., the background sound level), and if it is at or below the threshold it is classified as unobtrusive. In some embodiments, the classification module 354 classifies an audio source as obtrusive if it has a sound level greater than a threshold value (e.g., the background sound level) for at least a threshold period of time (e.g., more than 1 second), otherwise it is classified as unobtrusive. Other methods of classifying an audio source based on determined ATFs and/or received sound waves are also possible. For example, classification module can use various machine learning algorithms to classify an audio source.

To further illustrate, consider, for example, an audio system 300 in a local area that is an office. Employees and/or equipment in the office may generate some sound waves that represent a general background sound level of the office. Classification module 354 may measure and characterize the audio characteristics (e.g., frequencies, amplitudes, etc.) of the background sound level of the office. Classification module 354 determines that audio sources generating sound waves having audio characteristics significantly above the background sound level are obtrusive audio sources and audio sources generating sound waves having audio characteristics below the background sound level are unobtrusive audio sources. For example, the classification module 354 determines audio characteristics of the office. An employee in the office begins to speak loudly to another in an argument. The audio source detection module determines that the arguing employees are audio sources. The classification module determines that the amplitude of the sound waves generated by the arguing employees are above the background sound level. As such, the classification module 354 classifies the arguing employees as obtrusive audio sources.

In various embodiments, classification module can classify additional or fewer types of audio sources. Further, the audio sources may be classified by any criteria suitable for classifying audio sources. For example, an audio source can be classified as human, ambient, loud, soft, irregular, high-frequency, low-volume, etc. Many other types are possible.

A distraction reduction module 360 generates audio instructions that, when executed by the playback device array 320, generate an audio experience that reduces the degradation of a target audio experience caused by one or more audio sources (e.g., an obtrusive audio source) identified in a local area surrounding the audio system 300. For convenience, audio instructions that reduce the degradation of a target audio experience will be referred to as reduction instructions and, similarly, the audio experience presented when executing reduction instructions may be referred to as a modified audio experience. Distraction reduction module 360 generates reduction instructions that present a modified audio experience in a variety of manners as described below.

In an example, the distraction reduction module 360 generates reduction instructions that perform active noise cancellation when presenting a modified audio experience. Active noise cancellation generates and presents audio content that destructively interferes with audio content received from an audio source. To illustrate, an audio source (e.g., a non-target audio source) generates sound waves that, when perceived by a user of an audio system 300, degrade a target audio experience. The ASD module 350 determines the audio source in the local area of the headset. The ASD module 350 analyzes the received sound waves and determines a waveform of the sound waves. The ASD module 350 may also determine the waveform from parameters of a determined ATF for the identified audio source. The distraction reduction module 360 determines an anti-waveform for the determined waveform. The distraction reduction module 360 generates reduction instructions that, when executed by the playback device array 310, present the anti-waveform to the user. When the playback device array 310 presents the modified audio experience, the anti-waveform destructively interferes with the waveform of the sound waves generated by the audio source. Presentation of the anti-waveform reduces the experience degradation.

In an example, the distraction reduction module 360 generates reduction instructions that perform neutral sound masking when presenting a modified audio experience. Neutral sound masking generates and presents audio content that sound masks audio content received from an audio source with neutral sounds. To illustrate, an audio source (e.g., a non-target audio source) generates sound waves that, when perceived by a user of an audio system 300, degrade a target audio experience. The ASD module 350 determines the audio source in the local area of the headset. The ASD module 350 analyzes the received sound waves and determines a set of acoustic characteristics of the received sound waves. The acoustic characteristics may include frequency, amplitude, phase, delay, gain, or any other acoustic characteristics. The ASD module 350 may also determine the acoustic characteristics from parameters of a determined ATF for the identified audio source. The distraction reduction module 360 determines an acoustic signal that neutral sound masks the received sound waves ("neutral acoustic signal"). In various embodiments, the neutral acoustic signal may be white noise, pink noise, shaped white noise, a noise spectrum based on the audio characteristics, or any other neutral audio signal. In some cases, the neutral acoustic signal may be stored in the datastore 340. The distraction reduction module 360 generates reduction instructions that, when executed by the playback device array 310, present the neutral acoustic signal to the user as part of a modified audio experience. When the playback device array 310 presents the modified audio experience, the neutral acoustic signal neutral sound masks the sound waves generated by the audio source. Presentation of the neutral acoustic signal reduces the experience degradation.

In a similar example, the distraction reduction module 360 generates reduction instructions that, when executed by a playback device array 310, perform ambient sound masking for an identified audio source. Ambient sound masking is different than neutral sound masking in that ambient sound masking generates an audio signal using other audio sources identified in the local area of the audio system 300. For example, a local area includes both an obtrusive audio source and an unobtrusive audio source. The obtrusive audio source generates sound waves that degrade a target audio experience while the unobtrusive audio source generates sound waves that do not degrade a target audio experience. The ASD module 350 determines and classifies the audio sources in the local area of the headset. The ASD module 350 analyzes the received sound waves and determines a set of acoustic characteristics of the received sound waves for both the obtrusive audio source and unobtrusive audio source. The distraction reduction module 360 determines an acoustic signal that ambient sound masks the received sound waves ("ambient acoustic signal"). The ambient acoustic signal includes one or more of the audio characteristics of the unobtrusive audio source. The audio characteristics, in aggregate or individually, may represent an ambient background. For example, if the unobtrusive audio source is a fan, the ambient acoustic signal may include audio characteristics of the fan. The distraction reduction module 360 generates reduction instructions that, when executed by the playback device array 310, present the ambient acoustic signal as part of a modified audio experience to the user. When presented by the playback device array 310, the ambient acoustic signal ambient sound masks the sound waves generated by the obtrusive audio source using audio characteristics of the unobtrusive audio source. Presentation of the ambient acoustic signal reduces the experience degradation.

In various embodiments, the distraction reduction module 360 generates reduction instructions using the identified spatial location of an audio source. For example, distraction reduction module 360 can generate reduction instructions that, when executed by the playback device array 310, present a modified audio experience including audio content presented at a targeted direction and/or location. In various embodiments, the distraction reduction module 360 generates reduction instructions using HRTFs stored in the datastore 340, but could use many other transfer functions. Here, the targeted direction and/or location may include the identified spatial location of an identified audio source. For example, an audio source at a particular spatial location generates sound waves which degrade a target audio experience presented to a user. The location module 352 determines the spatial location of the audio source. The distraction reduction module 360 generates reduction instructions that presents, for example, a neutral signal at the determined spatial location of the audio source as part of the modified audio experience. In this manner, the user only perceives the neutral signal at the location of the audio source rather than in their entire auditory field. Other reduction instructions as described herein (e.g., active noise cancelling, ambient signals, etc.) can also be presented at a target location and/or direction.

In various embodiments, the distraction reduction module 360 generates reduction instructions using the determined type of an audio source(s). For example, the distraction reduction module 360 may generate reduction instructions for an active noise cancellation when the identified audio source is an obtrusive audio source. In another example, the distraction reduction module 360 may generate reduction instructions for neutral sound masking if the audio characteristics of sound waves received from an identified audio source includes particular audio characteristics, audio characteristics above (or below) a threshold, etc. In another example, the distraction reduction module 360 may generate reduction instructions for ambient sound masking if the ASD module 350 identifies an unobtrusive audio source in the local area of the audio system.

In some examples, the distraction reduction module 350 can present a modified audio experience in response to an input received from a user. For example, a user may state "Mute auditory distractions," and, in response, the audio system 300 takes any of the steps describe herein to present a modified audio experience. In some cases, distraction reduction module can present a modified audio experience that reduces degradation of a target audio experience by particular types of audio source. For example, a user may state "Mute dad" and the ASD module 350 identifies an audio source generating sound waves resembling a speech pattern for an adult male, generate reduction instructions for the sound waves, and present a modified audio experience that compensates for speech heard from an identified adult male. Because the modified audio experience only compensates for sound waves received from an adult male, a user is still able to hear other noises. For example, the user may perceive sound waves representing a notification alert from a nearby cellular device while not being able perceive sound waves generated by a nearby adult male. In some examples, the distraction reduction module 350 can automatically present modified audio experiences to a user based on any of the principles described herein. For example, the audio system 300 may determine an obtrusive audio source and automatically present a modified audio experience that compensates for the sound waves generated by the obtrusive audio source.

In some examples, the distraction reduction module 360 can present a modified audio experience based on the type of target audio experience presented to the user. The type of target audio experience may include any type of classification for a target audio experience. For example the type may be, movie, game, social, reading, etc. The distraction reduction module 360 may determine the type of the target audio experience. The distraction reduction module 360 may determine the type by accessing a type descriptor associated with the audio content of the target audio experience or by analyzing the sound waves of the audio content of the target audio experience. For example, a user is operating the audio system 300 to watch a movie. The movie has audio content stored in the datastore 340 for a target audio experience which is classified as movie. In another example, the distraction reduction module 360 receives the sound waves of the movie, analyzes the sound waves, and determines that the audio content is associated with a movie target audio experience. The distraction reduction module 360 can generate reduction instructions based on the determined type of the target audio experience. For example, when the type is movie, sound masking non-target audio sources may be perceived as a distraction in the user's auditory field. As such, distraction reduction module 360 generates reduction instructions that perform active noise cancelling, but not sound masking.

Note that the audio system 300 is continually receiving sounds from the acoustic sensor array 310 and identifying audio sources in the local area of the headset. Accordingly, the controller 330 can dynamically update (e.g., via the modules within the controller 330) the reduction instructions as relative locations change between the headset and audio sources within the local area. Further, the controller 300 can continuously generates reduction instructions such that the headset presents a modified audio experience when necessary. In other words, the audio system is configured to generate a modified audio experience in a local area with audio sources that are constantly changing.

Providing a Normalized Audio Experience

Figure 4:
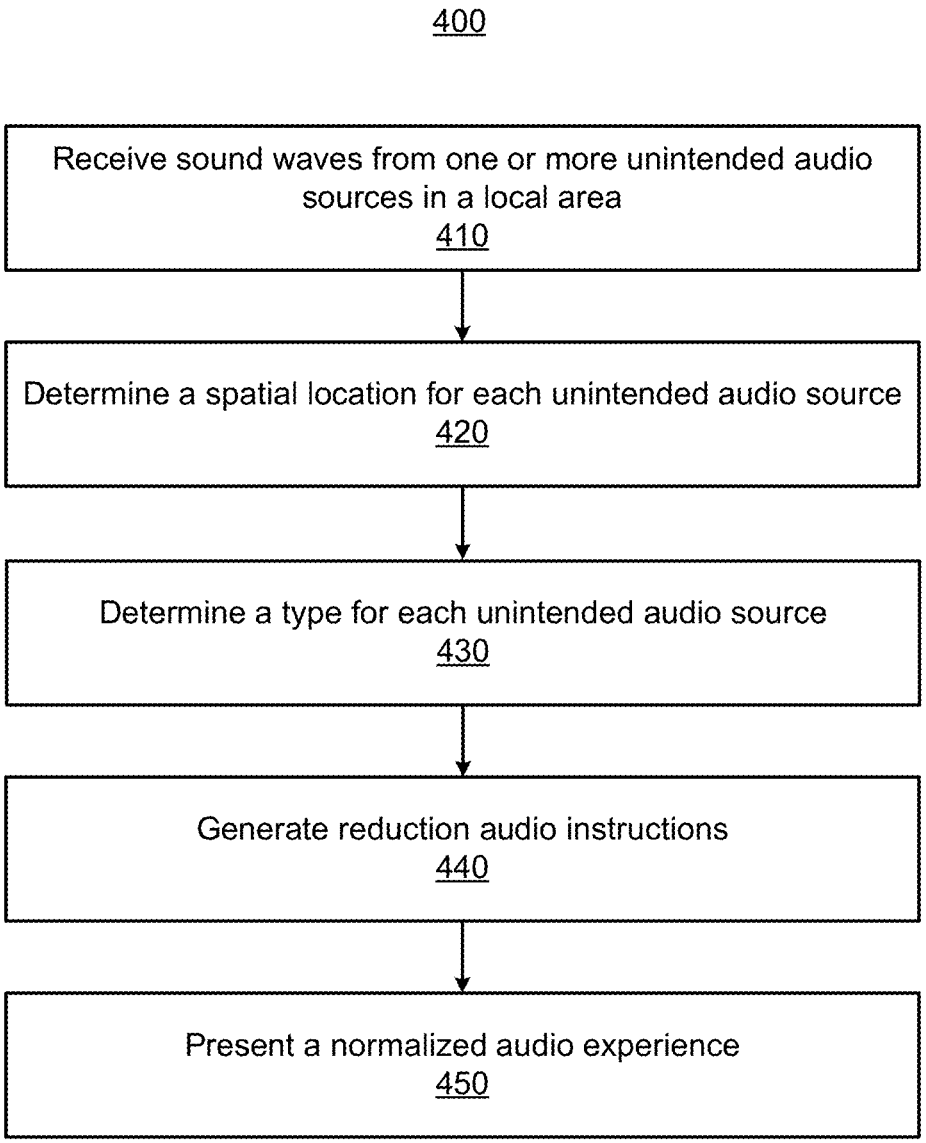
FIG. 4 is a process for generating a modified audio experience that compensates for the degradation of a target audio experience, according to one or more embodiments.

FIG. 4 is a flowchart illustrating a process 400 for presenting a modified audio experience to a user, in accordance with one or more embodiments. In one embodiment, the process of FIG. 4 is performed by components of an audio system (e.g., the audio system 300). Other entities may perform some or all of the steps of the process in other embodiments. Likewise, embodiments may include different and/or additional steps, or perform the steps in different orders. Process 400 will be described in reference to a user operating a headset with an audio system (e.g., audio system 300) in the local area illustrated in FIG. 2.

The audio system receives 410 sound waves from one or more non-target audio sources in the local area. The sound waves are perceived as distracting audio content in the auditory field of the user which degrade the target audio experience presented by the audio system. For example, referring to FIG. 2, several audio sources 220 generate sound waves 222 that are directed towards the user 210. One of the audio sources (e.g., audio source 220D) is not in the located in the local area 200, but the sound waves (e.g., sound waves 222D) generated by the audio source are perceived as originating in the audio field 202 of the user because they are reflected off of a surface 230 in the local area 200. Any of the sound waves 222 generated by the audio sources 220 may degrade the target audio experience presented to the user 210 by the headset 212.

Returning to FIG. 4, the audio system determines 420 the spatial location(s) of the non-target audio source(s) in the local area. The audio system may determine the spatial location(s) of the non-target audio sources based on the sound waves received by the audio system. For example, referring to FIG. 2, an audio source detection module (e.g., audio source detection module 350) of the headset 212 worn by the user 210 may identify the audio sources 220 in the auditory field 202 of the user. For example, the audio source detection module receives the sound waves 222B generated by the audio source 220B and identifies that audio characteristics in the received sound waves represent a non-target audio source. A location module (e.g., location module 352) of the headset 212 determines the spatial location of the identified audio source 220B. For example, the location module may determine a coordinate of the audio source 220B relative to the user 210 in the local area 200 in spherical coordinates. The headset 212 may similarly identify the other audio sources 220 and determine their spatial location in the local area 200. In instances where an audio source is outside of the local area 200 but still perceived as within the auditory field 202 by the user, the audio source detection module may determine a spatial location of an object (e.g., surface 230) where sound waves originate.

Returning to FIG. 4, the audio system determines 430 a type of the non-target audio source(s). The audio system may determine the type of the non-target audio source based on the sound waves received by the audio system. For example, referring to FIG. 2, a classification module (e.g., classification module 354) of headset 212 determines a type for each audio source 220 based on the sound waves 222 received from that audio source 220. To illustrate, the classification module may determine that audio sources 220B, 220C, and 220D are obtrusive audio sources because they do generate sound waves that degrade the target audio experience presented to the user. Similarly, the classification module may determine that audio source 220A is an unobtrusive audio source because it does not generate sound waves that degrade the target audio experience.

Returning to FIG. 4, the audio system generates 440 a set of reduction audio instructions based on any of the determined spatial location of the non-target audio source(s), the determined type of the audio source(s), and the audio properties of the sound waves received from the non-target audio source(s). The reduction audio instructions, when executed by the audio system, presents audio content that reduces the experience degradation by the non-target audio source(s) in the auditory field of the user. For example, referring to FIG. 2, a distraction reduction module (e.g., distraction reduction module 360) of the headset generates reduction audio instructions for each of the obtrusive audio sources in the local area. To illustrate, the distraction reduction module generates reduction instructions for active noise cancelling, ambient noise masking, and neutral noise masking for the obtrusive audio sources 220B, 220C, and 220D, respectively. The distraction reduction module uses HRTFs stored in a datastore (e.g., datastore 340) of the headset to generate the reduction instructions.

The audio system executes the reduction audio instructions to present audio content to the user that reduces experience degradation. In other words, the audio system presents 450 a modified audio experience to the user. The modified audio experience includes audio content that compensates for the sound waves generated by the non-target audio source(s). The audio content may be presented at the determined spatial locations of the non-target audio source (s). For example, referring to FIG. 2, the distraction reduction module presents a modified audio experience using the generated reduction instructions. The modified audio experience includes audio content that compensates for the sound waves received from each of the identified obtrusive audio sources. For example, the modified audio experience presents audio content that performs active noise cancellation for the sound waves received from the audio source 220B. The audio content is presented in the direction of the spatial location of the audio source 220B such that the active noise cancellation is performed on sound waves perceived as originating from the spatial location of the audio source 220B. Similarly, audio system presents audio content that performs ambient sound masking and neutral sound masking, respectively, on sound waves perceived to originate from the spatial locations of audio source 220C and the surface 230, respectively. The modified audio experience compensates for the sound waves received from the obtrusive audio sources and reduces the experience degradation.

The steps of process 400 can occur at any time during the operation of the headset 212. Importantly, as identified audio sources move through the auditory field 202 of the user 210, the audio system of the headset 212 can continuously generate reduction instructions. The reduction instructions can be executed by the audio system to continuously present a modified audio experience that reduces the degradation of a target audio experience caused by sound waves generated by the non-target audio sources. More simply, as distracting audio sources move through the user's auditory field 202, the audio system continuously generates an audio experience that compensates for those distractions and reduces the experience degradation.

Example of an Artificial Reality System

Figure 5:
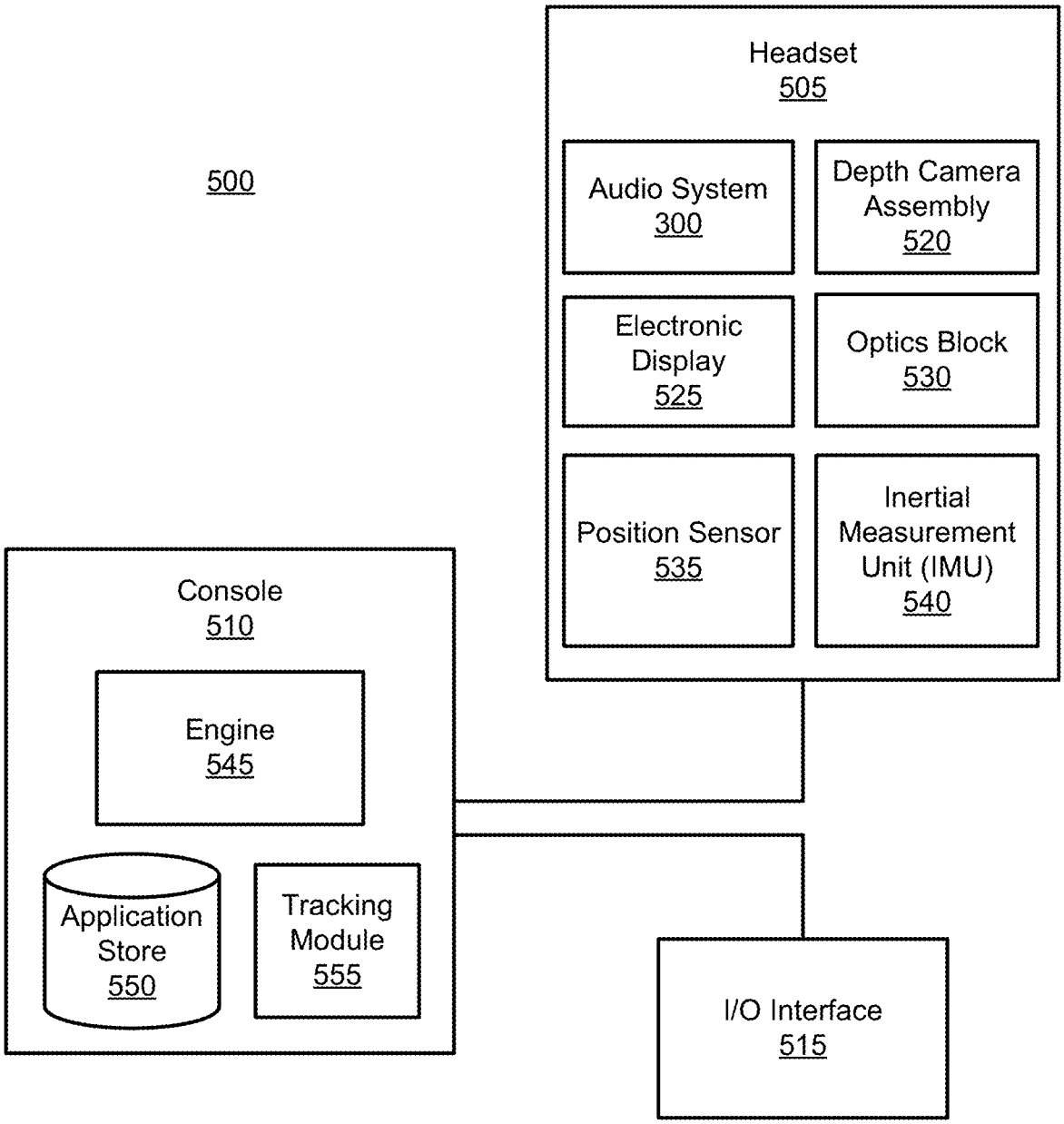
FIG. 5 is a block diagram of an example artificial reality system, according to one or more embodiments.

FIG. 5 is a system environment of a headset including the audio system 300 of FIG. 3, in accordance with one or more embodiments. The system 500 may operate in an artificial reality environment, e.g., a virtual reality, an augmented reality, a mixed reality environment, or some combination thereof. The system 500 shown by FIG. 5 comprises a headset 505 and an input/output (I/O) interface 515 that is coupled to a console 510. The headset 505 may be an embodiment of the headset 200. While FIG. 5 shows an example system 500 including one headset 505 and one I/O interface 515, in other embodiments, any number of these components may be included in the system 500. For example, there may be multiple headsets 505 each having an associated I/O interface 515 with each headset 505 and I/O interface 515 communicating with the console 510. In alternative configurations, different and/or additional components may be included in the system 500. Additionally, functionality described in conjunction with one or more of the components shown in FIG. 5 may be distributed among the components in a different manner than described in conjunction with FIG. 5 in some embodiments. For example, some or all of the functionality of the console 510 is provided by the headset 505.

The headset 505 presents content to a user comprising augmented views of a physical, real-world environment with computer-generated elements (e.g., two dimensional (2D) or three dimensional (3D) images, 2D or 3D video, sound, etc.). The headset 505 may be an eyewear device or a head-mounted display. In some embodiments, the presented content includes audio content that is presented via the audio system 300 that receives audio information (e.g., an audio signal) from the headset 505, the console 510, or both, and presents audio content based on the audio information.

The headset 505 includes the audio system 300, a depth camera assembly (DCA) 520, an electronic display 525, an optics block 530, one or more position sensors 535, and an inertial measurement Unit (IMU) 540. The electronic display 525 and the optics block 530 is one embodiment of a lens 110. The position sensors 535 and the IMU 540 is one embodiment of sensor device 114. Some embodiments of the headset 505 have different components than those described in conjunction with FIG. 5. Additionally, the functionality provided by various components described in conjunction with FIG. 5 may be differently distributed among the components of the headset 505 in other embodiments, or be captured in separate assemblies remote from the headset 505.

The audio system 300 generates a target audio experience for the user. Additionally described with reference to FIGS. 1-4, the audio system 300 detects, via a microphone array of the audio assembly 300, sound waves from one or more audio sources in a local area of the headset 505. The sound waves may be perceived by the user and degrade the target audio experience. The audio assembly 300 estimates array transfer functions (ATFs) associated with the sound waves, generates reduction audio instructions for a playback device array of the headset using the ATFs. The audio system 300 presents audio content, via a playback device array, based in part on the reduction audio instructions. The presented audio content generates a modified audio experience for the user that reduces the experience degradation caused by sound waves generated from the one or more audio sources.

The DCA 520 captures data describing depth information of a local environment surrounding some or all of the headset 505. The DCA 520 may include a light generator (e.g., structured light and/or a flash for time-of-flight), an imaging device, and a DCA controller that may be coupled to both the light generator and the imaging device. The light generator illuminates a local area with illumination light, e.g., in accordance with emission instructions generated by the DCA controller. The DCA controller is configured to control, based on the emission instructions, operation of certain components of the light generator, e.g., to adjust an intensity and a pattern of the illumination light illuminating the local area. In some embodiments, the illumination light may include a structured light pattern, e.g., dot pattern, line pattern, etc. The imaging device captures one or more images of one or more objects in the local area illuminated with the illumination light. The DCA 520 can compute the depth information using the data captured by the imaging device or the DCA 520 can send this information to another device such as the console 510 that can determine the depth information using the data from the DCA 520.

In some embodiments, the audio system 300 may utilize the depth information which may aid in identifying directions or spatial locations of one or more potential audio sources, depth of one or more audio sources, movement of one or more audio sources, sound activity around one or more audio sources, or any combination thereof.

The electronic display 525 displays 2D or 3D images to the user in accordance with data received from the console 510. In various embodiments, the electronic display 525 comprises a single electronic display or multiple electronic displays (e.g., a display for each eye of a user). Examples of the electronic display 525 include: a liquid crystal display (LCD), an organic light emitting diode (OLED) display, an active-matrix organic light-emitting diode display (AMOLED), waveguide display, some other display, or some combination thereof.

In some embodiments, the optics block 530 magnifies image light received from the electronic display 525, corrects optical errors associated with the image light, and presents the corrected image light to a user of the headset 505. In various embodiments, the optics block 530 includes one or more optical elements. Example optical elements included in the optics block 530 include: a waveguide, an aperture, a Fresnel lens, a convex lens, a concave lens, a filter, a reflecting surface, or any other suitable optical element that affects image light. Moreover, the optics block 530 may include combinations of different optical elements. In some embodiments, one or more of the optical elements in the optics block 530 may have one or more coatings, such as partially reflective or anti-reflective coatings.

Magnification and focusing of the image light by the optics block 530 allows the electronic display 525 to be physically smaller, weigh less, and consume less power than larger displays. Additionally, magnification may increase the field of view of the content presented by the electronic display 525. For example, the field of view of the displayed content is such that the displayed content is presented using almost all (e.g., approximately 110 degrees diagonal), and in some cases, all of the user's field of view. Additionally, in some embodiments, the amount of magnification may be adjusted by adding or removing optical elements.

In some embodiments, the optics block 530 may be designed to correct one or more types of optical error. Examples of optical error include barrel or pincushion distortion, longitudinal chromatic aberrations, or transverse chromatic aberrations. Other types of optical errors may further include spherical aberrations, chromatic aberrations, or errors due to the lens field curvature, astigmatisms, or any other type of optical error. In some embodiments, content provided to the electronic display 525 for display is pre-distorted, and the optics block 530 corrects the distortion when it receives image light from the electronic display 525 generated based on the content.

The IMU 540 is an electronic device that generates data indicating a position of the headset 505 based on measurement signals received from one or more of the position sensors 535. A position sensor 535 generates one or more measurement signals in response to motion of the headset 505. Examples of position sensors 535 include: one or more accelerometers, one or more gyroscopes, one or more magnetometers, another suitable type of sensor that detects motion, a type of sensor used for error correction of the IMU 540, or some combination thereof. The position sensors 535 may be located external to the IMU 540, internal to the IMU 540, or some combination thereof.

Based on the one or more measurement signals from one or more position sensors 535, the IMU 540 generates data indicating an estimated current position of the headset 505 relative to an initial position of the headset 505. For example, the position sensors 535 include multiple accelerometers to measure translational motion (forward/back, up/down, left/right) and multiple gyroscopes to measure rotational motion (e.g., pitch, yaw, and roll). In some embodiments, the IMU 540 rapidly samples the measurement signals and calculates the estimated current position of the headset 505 from the sampled data. For example, the IMU 540 integrates the measurement signals received from the accelerometers over time to estimate a velocity vector and integrates the velocity vector over time to determine an estimated current position of a reference point on the headset 505. Alternatively, the IMU 540 provides the sampled measurement signals to the console 510, which interprets the data to reduce error. The reference point is a point that may be used to describe the position of the headset 505. The reference point may generally be defined as a point in space or a position related to the eyewear device's 505 orientation and position.

The I/O interface 515 is a device that allows a user to send action requests and receive responses from the console 510. An action request is a request to perform a particular action. For example, an action request may be an instruction to start or end capture of image or video data, or an instruction to perform a particular action within an application. The I/O interface 515 may include one or more input devices. Example input devices include: a keyboard, a mouse, a hand controller, or any other suitable device for receiving action requests and communicating the action requests to the console 510. An action request received by the I/O interface 515 is communicated to the console 510, which performs an action corresponding to the action request. In some embodiments, the I/O interface 515 includes an IMU 540, as further described above, that captures calibration data indicating an estimated position of the I/O interface 515 relative to an initial position of the I/O interface 515. In some embodiments, the I/O interface 515 may provide haptic feedback to the user in accordance with instructions received from the console 510. For example, haptic feedback is provided when an action request is received, or the console 510 communicates instructions to the I/O interface 515 causing the I/O interface 515 to generate haptic feedback when the console 510 performs an action. The I/O interface 515 may monitor one or more input responses from the user for use in determining a perceived origin direction and/or perceived origin location of audio content.

The console 510 provides content to the headset 505 for processing in accordance with information received from one or more of: the headset 505 and the I/O interface 515. In the example shown in FIG. 5, the console 510 includes an application store 550, a tracking module 555 and an engine 545. Some embodiments of the console 510 have different modules or components than those described in conjunction with FIG. 5. Similarly, the functions further described below may be distributed among components of the console 510 in a different manner than described in conjunction with FIG. 5.

The application store 550 stores one or more applications for execution by the console 510. An application is a group of instructions, that when executed by a processor, generates content for presentation to the user. Content generated by an application may be in response to inputs received from the user via movement of the headset 505 or the I/O interface 515. Examples of applications include: gaming applications, conferencing applications, video playback applications, or other suitable applications.

The tracking module 555 calibrates the system environment 500 using one or more calibration parameters and may adjust one or more calibration parameters to reduce error in determination of the position of the headset 505 or of the I/O interface 515. Calibration performed by the tracking module 555 also accounts for information received from the IMU 540 in the headset 505 and/or an IMU 540 included in the I/O interface 515. Additionally, if tracking of the headset 505 is lost, the tracking module 555 may re-calibrate some or all of the system environment 500.

The tracking module 555 tracks movements of the headset 505 or of the I/O interface 515 using information from the one or more position sensors 535, the IMU 540, the DCA 520, or some combination thereof. For example, the tracking module 555 determines a position of a reference point of the headset 505 in a mapping of a local area based on information from the headset 505. The tracking module 555 may also determine positions of the reference point of the headset 505 or a reference point of the I/O interface 515 using data indicating a position of the headset 505 from the IMU 540 or using data indicating a position of the I/O interface 515 from an IMU 540 included in the I/O interface 515, respectively. Additionally, in some embodiments, the tracking module 555 may use portions of data indicating a position or the headset 505 from the IMU 540 to predict a future position of the headset 505. The tracking module 555 provides the estimated or predicted future position of the headset 505 or the I/O interface 515 to the engine 545. In some embodiments, the tracking module 555 may provide tracking information to the audio system 300 for use in generating the sound field reproduction filters.

The engine 545 also executes applications within the system environment 500 and receives position information, acceleration information, velocity information, predicted future positions, or some combination thereof, of the headset 505 from the tracking module 555. Based on the received information, the engine 545 determines content to provide to the headset 505 for presentation to the user. For example, if the received information indicates that the user has looked to the left, the engine 545 generates content for the headset 505 that mirrors the user's movement in a virtual environment or in an environment augmenting the local area with additional content. Additionally, the engine 545 performs an action within an application executing on the console 510 in response to an action request received from the I/O interface 515 and provides feedback to the user that the action was performed. The provided feedback may be visual or audible feedback via the headset 505 or haptic feedback via the I/O interface 515.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. A method comprising:

receiving, at a plurality of acoustic sensors of a wearable device, a set of sound waves from a non-target audio source located at a spatial location, the sound waves impacting a target audio experience presented to the user by the wearable device, the audio experience impacted by the user perceiving the sound waves of the non-target audio source at the spatial location in an auditory field of the user;

determining the spatial location of the non-target audio source based on the set of received sound waves;

generating a set of reduction audio instructions based on the determined spatial location and the received set of sound waves, the reduction audio instructions reducing the impact on the audio experience by compensating for the non-target audio source in the auditory field of the user when presented to the user by the wearable device, wherein the compensation includes the wearable device performing neutral sound masking; and presenting a modified audio experience using the set of reduction audio instructions, the modified audio experience, when presented to the user by the wearable device, having a reduced perception of the non-target audio source at the spatial location in the auditory field of the user.

2. The method of claim 1, wherein presenting an audio experience to the user by the wearable device comprises:

receiving a plurality of audio instructions representing a plurality of audio content elements; and presenting one or more of the audio content elements to the user using an audio assembly of the wearable device, the audio assembly configured to present the audio content elements in the auditory field of the user.

3. The method of claim 2, wherein the audio assembly includes a plurality of audio playback devices positioned around a frame of the wearable device and the audio content elements are presented from the plurality of audio playback devices.

4. The method of claim 1, wherein the set of reduction audio instructions comprise:

audio instructions presentable by the wearable device, the wearable device, when presenting the audio instructions, performing active noise canceling to reduce the perception of the non-target audio source at the spatial location in the auditory field of the user.

5. The method of claim 1, wherein generating the set of reduction audio instructions based on the spatial location and the received sound waves further comprises:

analyzing the sound waves to determine a waveform of the sound waves;

determining an anti-waveform based on the waveform, the anti-wave form destructively interfering with the waveform; and generating reduction audio instructions that, when presented by the wearable device, present the anti-waveform to the user, the anti-waveform destructively interfering with the sound waves such that the user has a reduced perception of the audio source at the spatial location in the auditory field of the user.

6. The method of claim 1, wherein generating the set of reduction audio instructions based on the spatial location and the received sound waves further comprises:

analyzing the sound waves to determine a set of acoustic characteristics of the sound waves;

determining a neutral acoustic signal that neutral sound masks the audio characteristics of the sound waves;

generating reduction audio instructions that, when executed by an audio assembly of the eyewear, present the neutral acoustic signal that neutral sound masks the sound waves such that the user has a reduced perception of the audio source at the spatial location in the auditory field of the user.

7. The method of claim 6, wherein the neutral acoustic signal is any of white noise, pink noise, shaped white noise.

8. The method of claim 1, wherein generating the set of reduction audio instructions based on the spatial location and the received sound waves further comprises:

analyzing the sound waves to determine a set of audio characteristics of the sound waves;

determining an ambient acoustic signal that sound masks the audio characteristics of one or more of the set of received sound waves, the ambient acoustic signal including audio characteristics of the sound waves received from the non-target audio source; and generating reduction audio instructions that, when presented by the wearable device to the user, present the ambient acoustic signal that ambient sound masks the sound waves such that the user has a reduced perception of the audio source at the spatial location in the auditory field of the user.

9. The method of claim 8, further comprising:

determining that the set of audio characteristics of the sound waves that represent an ambient background of the auditory field of the user, and wherein the determined acoustic signal includes audio characteristics representing the ambient background of the auditory field of the user.

10. The method of claim 1, wherein generating reduction audio instructions based on the spatial location and the received sound waves further comprises:

determining an orientation of the wearable device;

determining a relative orientation between the orientation of the wearable device and the spatial location of the non-target audio source;

determining a head related transfer function based on the determined relative orientation, the head related transfer function for modifying a target audio experience to compensate for the non-target audio source at the spatial location; and generating reduction audio instructions using the accessed head related transfer function.

11. The method of claim 1, wherein receiving a set of sound waves from a non-target audio source further comprises:

determining that the received sound waves originate from the non-target audio source.

12. The method of claim 11, wherein determining that the received sound waves originate from the non-target audio source further comprises:

determining a set of audio characteristics of the received sound waves; and determining that the set of audio characteristics are representative of the non-target audio source.

13. The method of claim 11, wherein generating reduction audio instructions is in response to determining that the received sound waves originate from the non-target audio source.

14. The method of claim 1, wherein generating the set of reduction audio instructions is in response to receiving, from the user, an input to generate the set of reduction audio instructions.

15. The method of claim 1, further comprising:

determining a type of the target audio experience presented to the user; and wherein generating the reduction audio instructions is based on the determined type of the intended audio experience.

16. A method comprising:

receiving, at a plurality of acoustic sensors of a wearable device, a set of sound waves from a non-target audio source located at a spatial location, the sound waves impacting a target audio experience presented to the user by the wearable device, the audio experience impacted by the user perceiving the sound waves of the non-target audio source at the spatial location in an auditory field of the user;

determining the spatial location of the non-target audio source based on the set of received sound waves;

generating a set of reduction audio instructions based on the determined spatial location and the received set of sound waves, the reduction audio instructions reducing the impact on the audio experience by compensating for the non-target audio source in the auditory field of the user when presented to the user by the wearable device, wherein the compensation includes the wearable device performing ambient sound masking; and presenting a modified audio experience using the set of reduction audio instructions, the modified audio experience, when presented to the user by the wearable device, having a reduced perception of the non-target audio source at the spatial location in the auditory field of the user.

17. A method comprising:

receiving, at a plurality of acoustic sensors of a wearable device, a set of sound waves from a non-target audio source located at a spatial location, the sound waves impacting a target audio experience presented to the user by the wearable device, the audio experience impacted by the user perceiving the sound waves of the non-target audio source at the spatial location in an auditory field of the user;

determining the spatial location of the non-target audio source based on the set of received sound waves;

generating a set of reduction audio instructions based on (i) the determined spatial location, (ii) the received set of sound waves, and (iii) a relative orientation between the wearable device and the spatial location of the non-target audio source, the reduction audio instructions implementing a head-related transfer function based at least on the relative orientation and to reduce the impact on the audio experience by compensating for the non-target audio source in the auditory field of the user when presented to the user by the wearable device; and presenting a modified audio experience using the set of reduction audio instructions, the modified audio experience, when presented to the user by the wearable device, having a reduced perception of the non-target audio source at the spatial location in the auditory field of the user.

* * * * *